US007222893B2

(12) United States Patent
Miyake et al.

(10) Patent No.: US 7,222,893 B2
(45) Date of Patent: May 29, 2007

(54) STRUCTURE FOR ATTACHING STRIKER, HAVING ATTACHMENT BRACKET INCLUDING BASE AND PROTRUDING PORTION

(75) Inventors: Yoshinori Miyake, Haga-gun (JP); Kazuhiko Yamada, Shioya-gun (JP); Kenichi Munenaga, Utsunomiya (JP)

(73) Assignee: Honda Motor Co., Ltd., Tokyo (JP)

( * ) Notice: Subject to any disclaimer, the term of this patent is extended or adjusted under 35 U.S.C. 154(b) by 95 days.

(21) Appl. No.: 11/098,313

(22) Filed: Apr. 4, 2005

(65) Prior Publication Data

US 2005/0218671 A1 Oct. 6, 2005

(30) Foreign Application Priority Data

Apr. 6, 2004 (JP) ..... 2004-112198

(51) Int. Cl.
*E05C 15/02* (2006.01)

(52) U.S. Cl. ..... 292/341.18; 292/341.14

(58) Field of Classification Search ..... 292/341.14, 292/341.18, 341.19
See application file for complete search history.

(56) References Cited

U.S. PATENT DOCUMENTS 4,209,194 A * 6/1980 Poe ..... 292/341.18
4,220,364 A * 9/1980 Poe ..... 292/341.18
4,869,537 A * 9/1989 Compeau et al. ..... 292/341.18
4,946,208 A * 8/1990 Myslicki et al. ..... 292/216

FOREIGN PATENT DOCUMENTS

JP 2001-152712 6/2001

* cited by examiner

*Primary Examiner*—Gary Estremsky
(74) *Attorney, Agent, or Firm*—Carrier, Blackman & Associates, P.C.; Joseph P. Carrier; William D. Blackman

(57) ABSTRACT

A structure for attaching a striker, having an attachment bracket including a base fastened to a panel, and a protruding portion joined to the base. The protruding portion extends in a direction different from a direction in which the base is arranged. The striker may have a swelling portion which swells in a direction going away from the base, and is attached to the protruding portion. The structure may include a cover member for covering an outside of the attachment bracket, and a work hole for adjusting the position of the striker is formed in the cover member. Typically, the striker has a base plate and a striker main portion. The base plate is selectively approachable to and retreatable from the attachment bracket via screw members which are inserted through a through hole provided in the protruding portion of the attachment bracket and are adjustably screwed into the base plate.

12 Claims, 5 Drawing Sheets

STRUCTURE FOR ATTACHING STRIKER, HAVING ATTACHMENT BRACKET INCLUDING BASE AND PROTRUDING PORTION

BACKGROUND OF THE INVENTION

1. Field of the Invention

The present invention relates to a structure for attaching a striker for vehicles such as cars.

Priority is claimed on Japanese Patent Application No. 2004-112198, filed Apr. 6, 2004, the content of which is incorporated herein by reference.

2. Description of Related Art

In an example of the structure for attaching a striker, the striker is tightened and fastened to a bracket which is provided at the back of a vehicle body panel.

Generally, the striker is attached in the final process of assembly of a vehicle body. More specifically, the striker is fastened after final fitting such as accurately positioning a door or a trunk lid in the assembled vehicle body is completed (see Japanese Unexamined Patent Application, First Publication No. 2001-152712).

However, in the above conventional technique in which the striker is attached to a bracket at the back of a vehicle body panel, it is difficult to perform the work of attaching the striker. In addition, when the attachment work is difficult, accurate positioning is also difficult and an additional or extra fitting or adjustment process may be necessary.

SUMMARY OF THE INVENTION

In view of the above circumstances, an object of the present invention is to provide a structure for attaching a striker, wherein the attachment and positioning can be easily performed without a high level of skill.

Therefore, the present invention provides a structure for attaching a striker (e.g., a striker 20 in an embodiment explained below), comprising:

an attachment bracket (e.g., an attachment bracket 19 in the embodiment) including a base (e.g., a base 23 in the embodiment) and a protruding portion (e.g., a protruding portion 24 in the embodiment) joined to the base, wherein the base is fastened to a panel (e.g., a trunk lid 2 the embodiment) and the protruding portion extends in a direction different from a direction in which the base is arranged, wherein the striker is attached to the protruding portion of the attachment bracket.

Typically, the panel is a member of a vehicle.

According to the above structure, in order to mount a striker, what is necessary is just to attach the striker to the protruding portion which protrudes from the base of the attachment bracket. Therefore, the attachment work can be precisely and easily performed while confirming the positions of the protruding portion and the striker.

Preferably, the striker has a swelling portion (e.g., a swelling portion 31 in the embodiment) which swells in a direction going away from the base of the attachment bracket. Accordingly, the engaging function necessary in the striker should be secured only in the swelling portion. Therefore, it is unnecessary to secure considerably large portions other than the swelling portion; thus, the attachment bracket can be small, thereby improving the flexibility in the arrangement of the striker.

The structure may further comprise a cover member (e.g., a cover member 33 in the embodiment) for covering an outside of the attachment bracket, wherein a work hole (e.g., work holes 39 in the embodiment) for adjusting the position of the striker is formed in the cover member.

Accordingly, the work for positioning the striker can be performed while the cover member is mounted, and additionally, the work hole of the cover member for covering the attachment bracket from the outside of the bracket can be formed at a position which is hidden from the outside, thereby improving the quality of appearance.

It is possible that:

the striker has a base plate (e.g., a base plate 27 in the embodiment) and a striker main portion (e.g., a striker main portion 28 in the embodiment); and the base plate is approachable to and retreatable from the attachment bracket via at least one screw member (e.g., bolts 25 in the embodiment) which is inserted through a through hole (e.g., a through hole 26 in the embodiment) provided in the protruding portion of the attachment bracket and is adjustably screwed into the base plate.

Accordingly, it is possible to position an opening/closing portion, to which the striker is attached, with respect to a vehicle body or the like, by making the striker approach to or retreat from the attachment bracket via the at least one screw member. Therefore, positioning or attachment work can be easily performed.

In the above structure, it is possible that:

two screw members are adjustably screwed into the base plate in a manner such that the striker main portion is positioned between the two screw members; and the base plate is variably inclined with respect to the attachment bracket, via the two screw members.

Accordingly, the degree of inclination of the striker main portion with respect to the protruding portion of the attachment bracket can be adjusted by adjusting the quantity of screwing of each screw member. Therefore, the direction of inclination and the direction of approach and retreat of the striker main portion with respect to the protruding portion of the attachment bracket can be finely adjusted.

DETAILED DESCRIPTION OF THE INVENTION

Hereinafter, embodiments according to the present invention will be explained with reference to the drawings.

Figure 1:
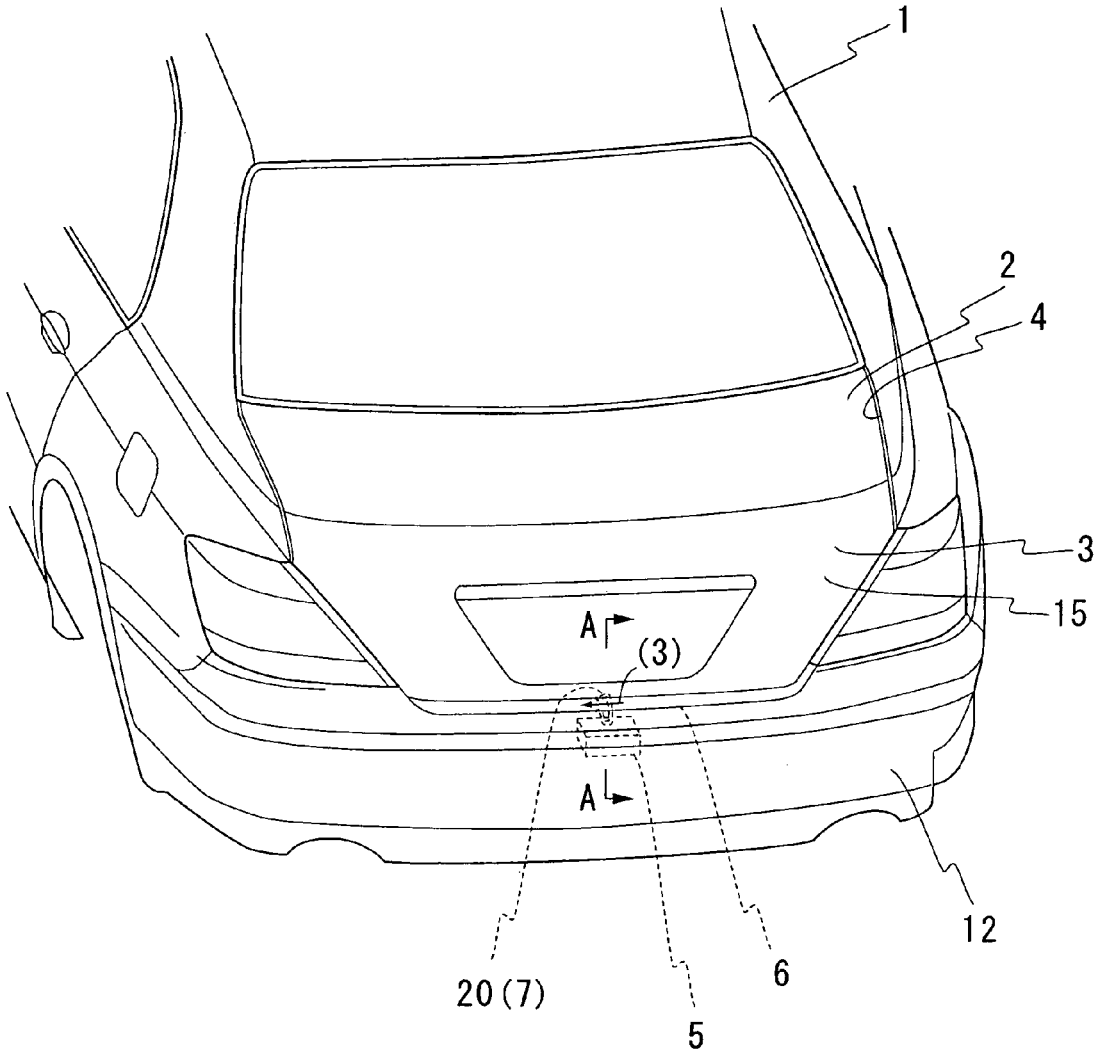
FIG. 1 is a perspective view showing a rear portion of a vehicle in an embodiment according to the present invention.

FIG. 1 is a perspective view showing a rear portion of a vehicle in an embodiment according to the present invention.

As shown in the figure, in a rear portion of a vehicle body 1, a trunk lid 2 (i.e., a panel (member)) is provided, which can be opened and closed. The trunk lid 2 has a rear wall 3 which extends downward so as to secure a wide space at a rear portion of a trunk opening 4. A locking device 5 is provided at a lower edge of the trunk opening 4, and a striker unit 7 corresponding to the locking device 5 is attached to a lower face 6 of the rear wall 3 of the trunk lid 2.

Figure 2:
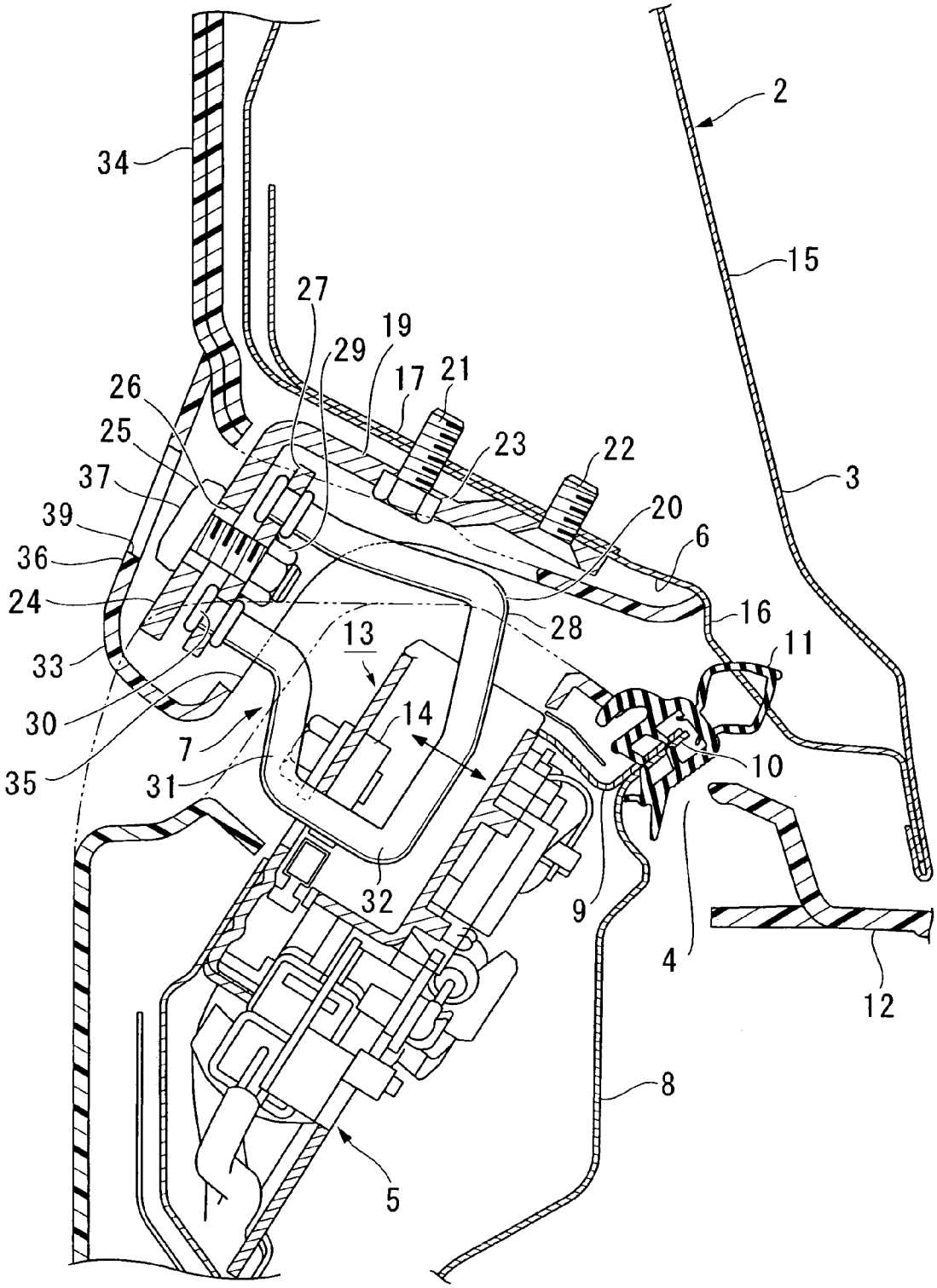
FIG. 2 is a sectional view along line A—A in FIG. 1.
Figure 3:
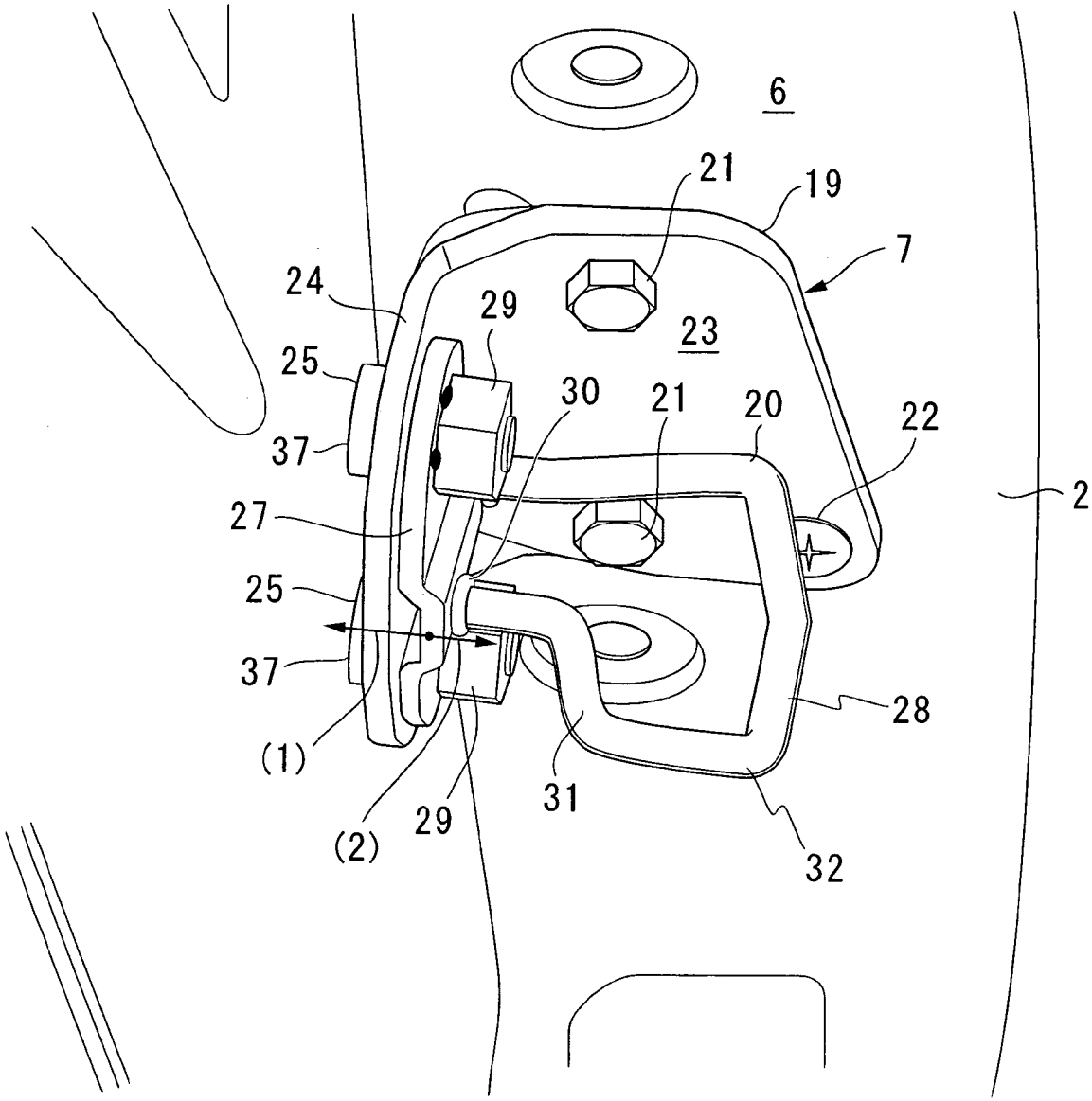
FIG. 3 is a perspective view showing a main portion including a striker unit, viewed from the bottom, the cover member not being shown.

FIG. 2 is a sectional view along line A—A in FIG. 1. FIG. 3 is a perspective view showing a main portion including a striker unit, viewed from the bottom, the cover member not being shown. As shown in FIGS. 2 and 3, a reinforcement 9 is joined to a rear end panel 8 at a rear portion of the vehicle body 1, thereby forming a closed-section structure in the rear portion of the vehicle body along the width direction of the vehicle. To a joint flange portion 10 of the rear end panel 8 and the reinforcement 9, a trunk weatherstrip 11 is attached, which functions as a peripheral edge of the trunk opening 4. At the back of the rear end panel 8, a bumper face 12 is provided, and in the vicinity of the upper face of the bumper face 12, the lower edge of the trunk lid 2 is positioned when the trunk lid 2 is closed.

The locking device 5, mounted in the closed-section structure formed by the rear end panel 8 and the reinforcement 9, has a locking main portion 13. A striker 20 (explained below) enters through an upper opening 14 of the locking main portion 13, so that the striker 20 is engaged with the locking device 5.

The trunk lid 2 is formed by an outer panel 15 and an inner panel 16, whose peripheral edges are wound and tightened together as shown in FIG. 2. When the trunk lid 2 is closed, the lower edge of the lid approaches the upper face of the bumper face 12. A reinforcement 17 is joined to the lower face 6 of the rear wall 3 of the trunk lid 2, that is, to the back face of the inner panel 16. Together with the reinforcement 17, the striker unit 7 is also attached to the inner panel 16.

The striker unit 7 is composed of an attachment bracket 19 and a striker 20 attached to the attachment bracket 19.

The attachment bracket 19, a thick metal plate having an L-shaped section, has (i) a base 23 fastened to the inner panel 16 and the reinforcement 17 via two bolts 21 and 21 and a screw 22, and (ii) a protruding portion 24, integrally formed with the base 23, extending from the base 23 downward (i.e., in a direction different from the direction in which the base 23 is arranged). Specifically, the base 23 of the attachment bracket 19 is arranged at an oblique angle backward and downward, in a manner such that the base 23 is arranged along the lower end of the closed trunk lid 2, and the protruding portion 24 is arranged at an oblique angle backward and frontward, that is, in a direction substantially perpendicular to the direction in which the base 23 is arranged.

In the protruding portion 24, a through hole 26 is provided for a bolt 25 (i.e., a screw member) for fastening a base plate 27 of the striker 2.

The striker 20 is composed of the base plate 27 and a striker main portion 28. The base plate 27 is a metal member attached to the protruding portion 24 of the attachment bracket 19. Two weld nuts 29 are attached to the base plate 27 in the width direction of the vehicle, and two bolts 25, inserted through the through hole 26 of the protruding portion 24, are screwed into the weld nuts 29. Accordingly, the base plate 27 of the striker 20, and therefore the striker 20 itself, can be closer to or farther from the attachment bracket 19 by using the two bolts 25 (see the double-headed arrow in FIG. 2).

To the base plate 27, the striker main portion 28, having a loop shape and a rounded sectional shape, is fastened via caulking portions 30. The caulking portions 30 are arranged on the base plate 27 in a manner such that the line drawn between the caulking portions 30 and the line between the weld nuts 29 cross each other, thereby forming a loop of the striker main portion 28 in the vertical direction. The striker main portion 28 has a swelling portion 31 at the head side, which swells downward, that is, in a direction going away from the base 23 of the attachment bracket 19.

The lower side 32 of the swelling portion 31 is arranged backward at an oblique angle (see FIG. 2), that is, in a direction perpendicular to the locus of approach to the locking main portion 13 of the locking device 5. Accordingly, this lower side 32 engages with the locking main portion 13 of the locking device 5, thereby locking the trunk lid 2.

Figure 4:
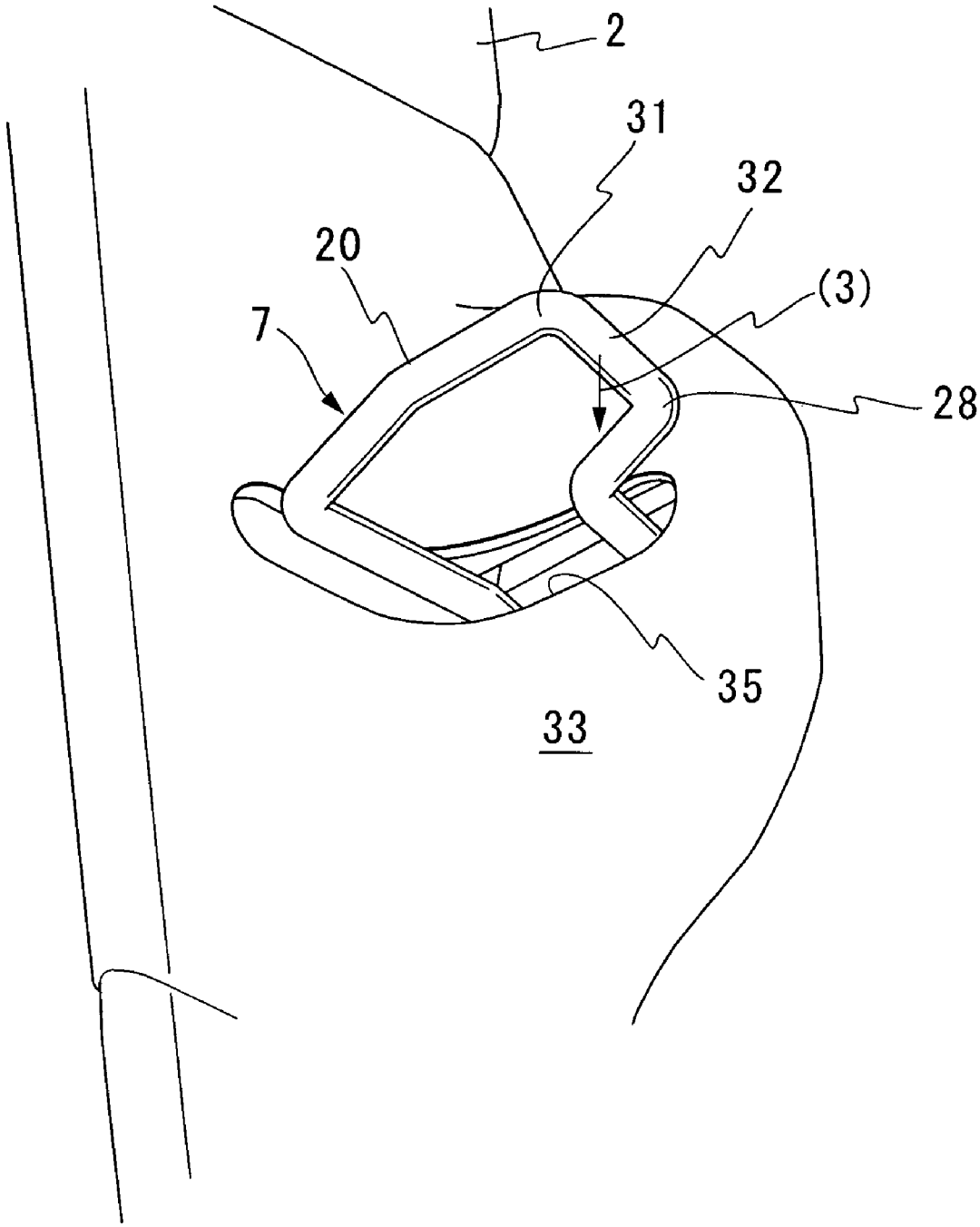
FIG. 4 is a perspective view of a portion for attaching the striker in the trunk lid, viewed from the outside of the interior of the vehicle.
Figure 5:
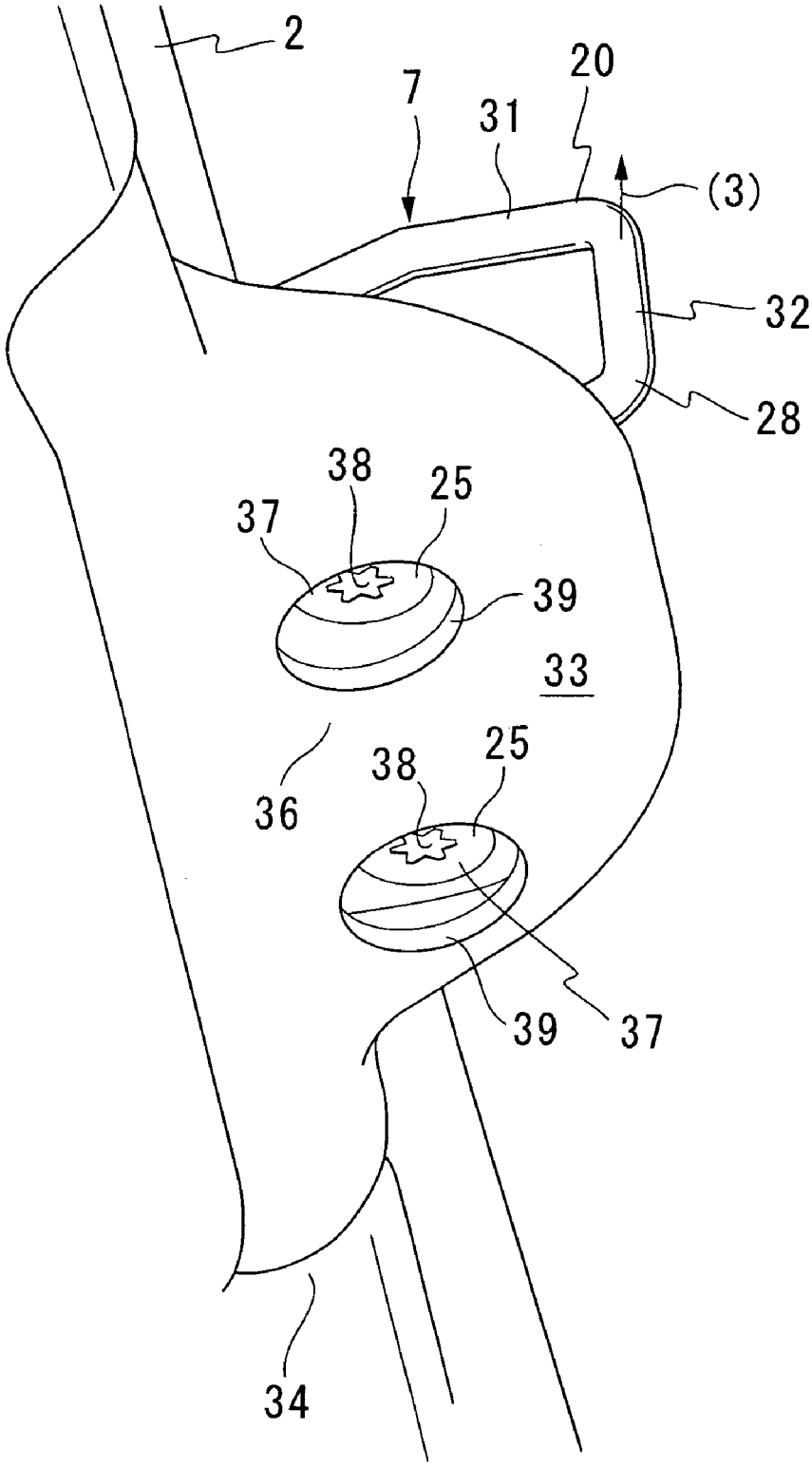
FIG. 5 is a perspective view of a portion for attaching the striker in the trunk lid, viewed from the trunk interior.

As shown in FIG. 2, a cover member 33 (not shown in FIG. 3) made of a resin is provided at the outside of the attachment bracket 19. The cover member 33 is integrally formed with an interior material 34 attached to the inner panel 16 of the trunk lid 2. FIG. 4 is a perspective view of a portion for attaching the striker 20 in the trunk lid 2, viewed from the outside of the interior of the vehicle. As shown in FIG. 4, the cover member 33 has an L-shaped slit 35 arranged along the base 23 and the protruding portion 24 of the attachment bracket 19, so that the striker main portion 28 is exposed through the slit 35. This cover member 33 also covers the back face of the protruding portion 24 of the attachment bracket 19, and in a cover wall 36 which faces the back face, small work holes 39 for exposing only engaging portions 38 (see FIG. 5) of the heads 37 of the two bolts 25 are formed. Here, the work holes 39, open toward the trunk interior, are hidden from the outside, that is, the back side of the vehicle body 1.

According to the above embodiment, in order to attach the striker 20 while positioning the striker, the striker 20 is attached to the protruding portion 24 which protrudes from the base 23 of the attachment bracket 19, so that the attachment work can be precisely and easily performed while confirming the positions of the protruding portion 24 and the striker 20. That is, the attachment work for the striker 20 does not include any work performed at the back side of the inner panel 16 of the trunk lid 2, or the like. Therefore, a high level of skill is not necessary and the attachment work can be easily performed, thereby simply performing precise positioning or fitting in a short time.

In addition, the swelling portion 31 is provided in a head portion of the striker main portion 28, where the swelling portion 31 swells downward, that is, in a direction going away from the base 23 of the attachment bracket 19. Therefore, the engaging function necessary in the striker 20 should be secured only in the swelling portion 31. Accordingly, it is unnecessary to secure considerably large portions other than the swelling portion 31; thus, the attachment bracket 19 can be small, thereby improving the flexibility in the arrangement of the striker 20.

Furthermore, the cover member 33 is provided at the outside of the attachment bracket 19, and the work holes 39 for adjusting the position of the striker 20 are formed in the cover member 33. Therefore, the work for positioning the striker 20 can be performed while the cover member 33 is mounted, and additionally, the work holes 39 of the cover member 33 for covering the attachment bracket 19 from the outside of the bracket can be formed at positions which are hidden from the outside, that is, the trunk interior, thereby improving the quality of appearance.

In the positioning of the striker 20, when the two bolts 25 are screwed by the same distance, the base plate 27 of the striker 20 approaches the protruding portion 24 of the attachment bracket 19 (see the arrow "(1)" in FIG. 3). Conversely, when both bolts 25 are loosened, the base plate 27 of the striker 20 separates from the protruding portion 24 of the attachment bracket 19 (see the arrow "(2)" in FIG. 3).

Accordingly, a step between the trunk lid 2 and the vehicle body panel around the trunk opening 4 (refer to FIG. 1) can be easily adjusted.

In FIG. 1, when viewed from the back side of the vehicle, if the width of the parting portion between the trunk lid 2 and the peripheral edge of the vehicle body panel surrounding the trunk opening 4 is not equal at the right and the left sides of the trunk lid 2, for example, if the parting portion at the left side is narrower, this inequality can be overcome by slightly displacing the lower side 32 of the swelling portion 31 of the striker main portion 28 to the left side. More specifically, in this case, among two bolts 25 in FIG. 5, the quantity of screwing of the upper bolt 25 is increased in comparison with the lower bolt 25, so that the striker main portion 28 is inclined to the direction indicated by the arrow "(3)" in FIGS. 1, 4, and 5. According to this inclination, the lower side 32 of the swelling portion 31 of the striker main portion 28 is displaced in the width direction of the vehicle, so that the trunk lid 2 is relatively positioned toward the right side in FIG. 1 with respect to the trunk opening 4.

Accordingly, the direction of inclination and the direction of approach and retreat of the striker main portion 28 with respect to the protruding portion 24 of the attachment bracket 19 can be finely adjusted, thereby easily and correctly performing the work for adjusting the striker 20.

While preferred embodiments of the invention have been described and illustrated above, it should be understood that these are exemplary of the invention and are not to be considered as limiting. Additions, omissions, substitutions, and other modifications can be made without departing from the spirit or scope of the present invention. Accordingly, the invention is not to be considered as being limited by the foregoing description, and is only limited by the scope of the appended claims.

For example, in the above embodiment, the striker unit 7 is provided at the trunk lid 2. However, the present invention can be applied to a constitution in which the striker unit 7 is attached to the vehicle (main) body side. In addition, instead of integrally forming the cover member 33 and the interior material 34, the cover member 33 may be detachably attached.

What is claimed is:

1. A structure for attaching a striker in a vehicle, comprising:

an attachment bracket including a base and a protruding portion joined to the base, wherein the base is adapted to be fastened to a trunk lid of a body of the vehicle, and the protruding portion extends in a direction different from a direction in which the base is arranged, wherein the striker has a base plate and a striker main portion, and is attached to the protruding portion of the attachment bracket; and two screw members are screwed through a through hole of the attachment bracket into the base plate in a manner such that the striker main portion is positioned between the two screw members along a width direction of the vehicle and a distance is provided between the attachment bracket and the base plate, so that the striker is variably inclinable in the width direction of the vehicle with respect to the attachment bracket.

2. The structure as claimed in claim 1, wherein the striker has a swelling portion which swells in a direction going away from the base of the attachment bracket.

3. The structure as claimed in claim 2, wherein:

the base plate is approachable to and retreatable from the attachment bracket via the screw members inserted through the through hole provided in the protruding portion of the attachment bracket.

4. The structure as claimed in claim 1, further comprising:

a cover member adapted to be operatively fastened to the trunk lid of the vehicle body for covering an outside of the attachment bracket, wherein a work hole for adjusting the position of the striker is formed in the cover member; wherein said screw members are accessible through the work hole.

5. The structure as claimed in claim 1, wherein:

the base plate is approachable to and retreatable from the attachment bracket via the screw members inserted through the through hole provided in the protruding portion of the attachment bracket.

6. The structure as claimed in claim 1, wherein said distance is maintained between the attachment bracket and the base plate.

7. A vehicular striker structure, comprising:

a vehicle body having a trunk lid;

an attachment bracket including a base and a protruding portion joined to the base, wherein the base is fastened to the trunk lid and the protruding portion extends in a direction different from a direction in which the base is arranged;

a striker having a base plate and a striker main portion, and attached to the protruding portion of the attachment bracket; and two screw members screwed through a through hole of the attachment bracket into the base plate in a manner such that the striker main portion is positioned between the two screw members along a width direction of the vehicle and a distance is provided between the attachment bracket and the base plate, so that the striker is variably inclinable in the width direction of the vehicle with respect to the attachment bracket.

8. The structure as claimed in claim 7, wherein the striker has a swelling portion which swells in a direction going away from the base of the attachment bracket.

9. The structure as claimed in claim 8, wherein:

the base plate is approachable to and retreatable from the attachment bracket via the screw members inserted through the through hole provided in the protruding portion of the attachment bracket.

10. The structure as claimed in claim 7, further comprising:

a cover member operatively fastened to the trunk lid, and which covers an outside of the attachment bracket, wherein a work hole for adjusting the position of the striker is formed in the cover member.

11. The structure as claimed in claim 7, wherein:

the base plate is approachable to and retreatable from the attachment bracket via the screw members inserted through the through hole provided in the protruding portion of the attachment bracket.

12. The structure as claimed in claim 7, wherein said distance is maintained between the attachment bracket and the base plate.

* * * * *